US010406049B2

(12) United States Patent
Liang et al.

(10) Patent No.: US 10,406,049 B2
(45) Date of Patent: Sep. 10, 2019

(54) MOBILE CARRIER AND STEERING ADJUSTMENT MECHANISM

(71) Applicant: Wistron Corporation, New Taipei (TW)

(72) Inventors: Chen-Yi Liang, New Taipei (TW); Cheng-Hsing Liu, New Taipei (TW); Shu-Hsuan Lin, New Taipei (TW)

(73) Assignee: Wistron Corporation, New Taipei (TW)

( * ) Notice: Subject to any disclaimer, the term of this patent is extended or adjusted under 35 U.S.C. 154(b) by 0 days.

(21) Appl. No.: 15/973,543

(22) Filed: May 8, 2018

(65) Prior Publication Data

US 2019/0224058 A1 Jul. 25, 2019

(30) Foreign Application Priority Data

Jan. 24, 2018 (TW) ..... 107102579 A

(51) Int. Cl.
*A61G 5/00* (2006.01)
*A61G 5/10* (2006.01)
*A61G 5/08* (2006.01)

(52) U.S. Cl.
CPC ..... *A61G 5/1051* (2016.11); *A61G 5/08* (2013.01)

(58) Field of Classification Search
CPC .... A61G 7/0528; A61G 5/043; A61G 5/1051; B60B 33/045; B60B 33/021; B60B 33/0052
See application file for complete search history.

(56) References Cited

U.S. PATENT DOCUMENTS 3,165,314 A * 1/1965 Clearman ..... A61H 3/04 135/67
3,675,269 A * 7/1972 Closa ..... B60B 33/0052 16/18 A
3,928,888 A * 12/1975 Lapham ..... B60B 33/0052 16/18 A
4,000,912 A * 1/1977 Donald ..... B60B 33/045 267/71
4,034,436 A * 7/1977 Ginder ..... B60B 33/0052 16/18 A (Continued)

FOREIGN PATENT DOCUMENTS

CN 205113436 3/2016

*Primary Examiner* — Hau V Phan
(74) *Attorney, Agent, or Firm* — JCIPRNET

(57) ABSTRACT

A mobile carrier includes a first frame, a directional wheel pivoted to the first frame, a second frame pivoted to the first frame, a steering adjustment mechanism connected to the second frame, and a steering wheel. The steering adjustment mechanism includes a first rotating element and a second rotating element coupled to the first rotating element. When a first rotating axis of the first rotating element is perpendicular to a plane, the first and the second rotating elements are locked to each other and are capable of rotating around the first rotating axis simultaneously. When a second rotating axis of the second rotating element is perpendicular to the plane, rotational degree of freedom of the first rotating element is restricted, and the second rotating element is capable of rotating around the second rotating axis relative to the first rotating element. A steering adjustment mechanism is also provided.

18 Claims, 7 Drawing Sheets

(56) References Cited

U.S. PATENT DOCUMENTS

| | | | | |
|---|---|---|---|---|
| 5,669,466 | A * | 9/1997 | Cheng | B60B 33/021 16/35 R |
| 5,911,235 | A * | 6/1999 | Henderson | B60B 33/0052 135/85 |
| 6,557,870 | B2 * | 5/2003 | Cheng | B62B 7/04 16/35 R |
| 6,908,087 | B2 * | 6/2005 | Wintersgill | B60B 33/0002 16/35 R |
| 7,055,835 | B2 * | 6/2006 | Wu | A61G 5/043 280/124.128 |
| 8,292,327 | B2 | 10/2012 | Araya Moreno et al. | |
| 8,789,662 | B2 * | 7/2014 | Childs | A61G 7/0528 16/35 R |
| 2010/0136858 | A1 | 6/2010 | King et al. | |

* cited by examiner

MOBILE CARRIER AND STEERING ADJUSTMENT MECHANISM

CROSS-REFERENCE TO RELATED APPLICATION

This application claims the priority benefit of Taiwan application serial no. 107102579, filed on Jan. 24, 2018. The entirety of the above-mentioned patent application is hereby incorporated by reference herein and made a part of this specification.

BACKGROUND

Field of the Invention

The invention relates to a carrier and an adjustment mechanism, and more particularly, to a mobile carrier and a steering adjustment mechanism.

Description of Related Art

In order to meet market requirements for rehabilitation and medical care and to aid people who have difficulties in walking or undertake rehabilitation after surgeries (illness), corresponding carriers, e.g., wheelchairs or walking aid devices, are provided at present. A commonly seen wheelchair is provided mainly for a user to sit thereon and is electrically or manually driven to move. A commonly seen walking aid device is provided for a user to hold a handle bar thereof by hands, such that the user can be supported and push the walking aid device to move during the walking process, thereby reducing the burden of walking.

Currently, a carrier integrated with the riding function of the wheelchair and the walking-aid function of the walking aid device has been provided, and the user can switch between the functions depending on personal needs. Usually, the carrier includes a frame and a steering wheel which is pivoted to the frame and employed to assist the carrier to turn. Taking the ground as a reference plane, as an included angle between the frame and the ground changes, an included angle between a rotating shaft in the steering wheel for being pivoted to the frame and the ground also changes. In a condition that the rotating shaft in the steering wheel for being pivoted to the frame is not perpendicular to the ground, if the steering wheel is to be turned relative to the frame, the steering wheel may receive a greater resistance force, which causes unsmoothness in turning, or even causes the carrier to overturn.

SUMMARY

The invention provides a mobile carrier and a steering adjustment mechanism having preferable use reliability.

A mobile carrier of the invention includes a first frame, a directional wheel, a second frame, a steering adjustment mechanism and a steering wheel. The first frame has a first end portion and a second end portion opposite to each other. The directional wheel is pivoted to the first end portion. The second frame is pivoted to the second end portion. The steering adjustment mechanism is connected to the second frame, and the steering adjustment mechanism and the second end portion are respectively located at two opposite sides of the second frame. The steering adjustment mechanism includes a first rotating element and a second rotating element coupled to the first rotating element, wherein the first rotating element has a first rotating axis, and the second rotating element has a second rotating axis. The steering wheel is pivoted to the second rotating element. When the first rotating axis is perpendicular to a plane, the first rotating element and the second rotating element are locked to each other, and the first rotating element and the second rotating element are capable of rotating around the first rotating axis simultaneously. When the second rotating axis is perpendicular to the plane, a rotational degree of freedom of the first rotating element is restricted, and the second rotating element is capable of rotating around the second rotating axis relative to the first rotating element.

In an embodiment of the invention, the first rotating axis and the second rotating axis are not parallel to each other.

In an embodiment of the invention, the steering adjustment mechanism further includes a fixing element and a connecting element. The fixing element is fixed to the second frame, wherein the first rotating element is pivoted to the fixing element. The connecting element has a third end portion and a fourth end portion opposite to each other, wherein the third end portion is connected to the first rotating element, and the fourth end portion is fixed to the second rotating element.

In an embodiment of the invention, the fixing element has a first hollow portion, the first rotating element further has a second hollow portion, and the first hollow portion is sleeved on the second hollow portion. The steering adjustment mechanism further includes a bearing, wherein the bearing is disposed in the first hollow portion and sleeved on the second hollow portion.

In an embodiment of the invention, the third end portion penetrates into the second hollow portion.

In an embodiment of the invention, the mobile carrier further includes a linking element and a position-limiting element. The linking element is connected to the first frame and the second frame. The position-limiting element is connected to the linking element, wherein the first rotating element further has a position-limiting portion, and the position-limiting element extends toward the position-limiting portion. When the first rotating axis is perpendicular to the plane, the position-limiting element and the position-limiting portion are separated from each other. During the process of the second frame and the first frame rotating relative to each other to cause the second rotating axis to be perpendicular to the plane, the second frame drives the linking element to move relative to the first frame, and the linking element drives the position-limiting element to move toward the position-limiting portion to generate structural interference with the position-limiting portion, so as to restrict the rotational degree of freedom of the first rotating element.

In an embodiment of the invention, the fixing element has a first guide portion, and the position-limiting element passes through the first guide portion.

In an embodiment of the invention, the second frame has a second guide portion, the position-limiting portion and the second guide portion are respectively located at two opposite sides of the first guide portion, and the position-limiting element passes through the first guide portion.

In an embodiment of the invention, the mobile carrier further includes a sleeve connected to the linking element, wherein the position-limiting element passes through the sleeve and is configured to move back and forth relative to the sleeve.

In an embodiment of the invention, the linking element has a sliding connection portion and a pivoting portion opposite to each other, and the first frame further has a sliding guide portion. The sliding connection portion is slidably disposed in the sliding guide portion, and the pivoting portion is pivoted to the second frame.

A steering adjustment mechanism of the invention includes a first rotating element and a second rotating element. The second rotating element is coupled to the first rotating element, wherein the first rotating element has a first rotating axis, and the second rotating element has a second rotating axis. When the first rotating axis is perpendicular to a plane, the first rotating element and the second rotating element are locked to each other, and the first rotating element and the second rotating element rotate around the first rotating axis simultaneously. When the second rotating axis is perpendicular to the plane, a rotational degree of freedom of the first rotating element is restricted, and the second rotating element rotates around the second rotating axis relative to the first rotating element.

To sum up, the mobile carrier of the invention can ensure that through the steering adjustment mechanism, the steering wheel can rotate around the rotating axis perpendicular to the plane (or the ground). In this way, the smoothness of the mobile carrier when being turned can be increased, and the mobile carrier when being turned can be prevented from being overturned, so as to obtain preferable use reliability.

In order to make the aforementioned and other features and advantages of the invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1A:
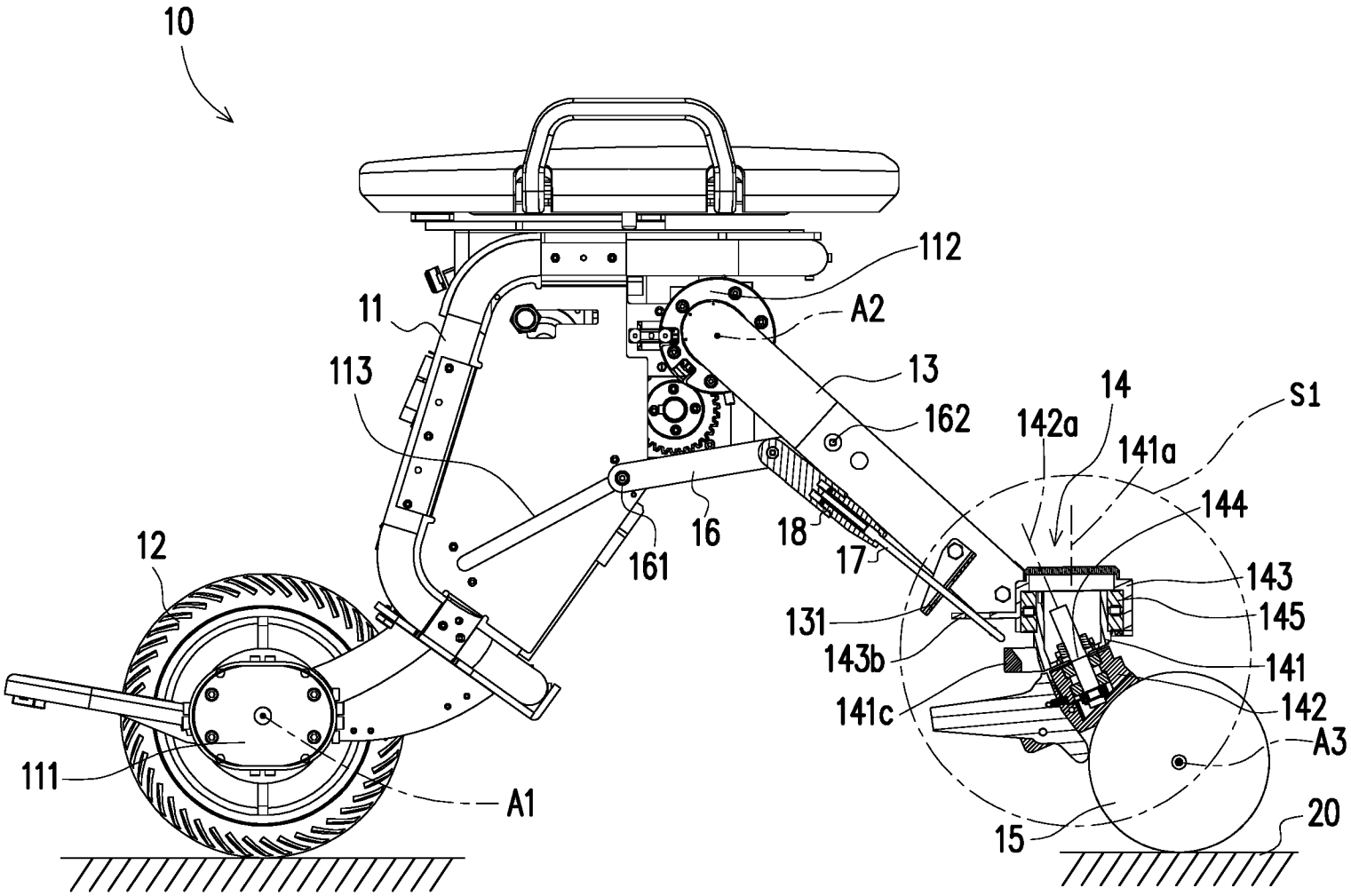
FIG. 1A is a schematic partial diagram illustrating a mobile carrier in a first state according to an embodiment of the invention.
Figure 1B:
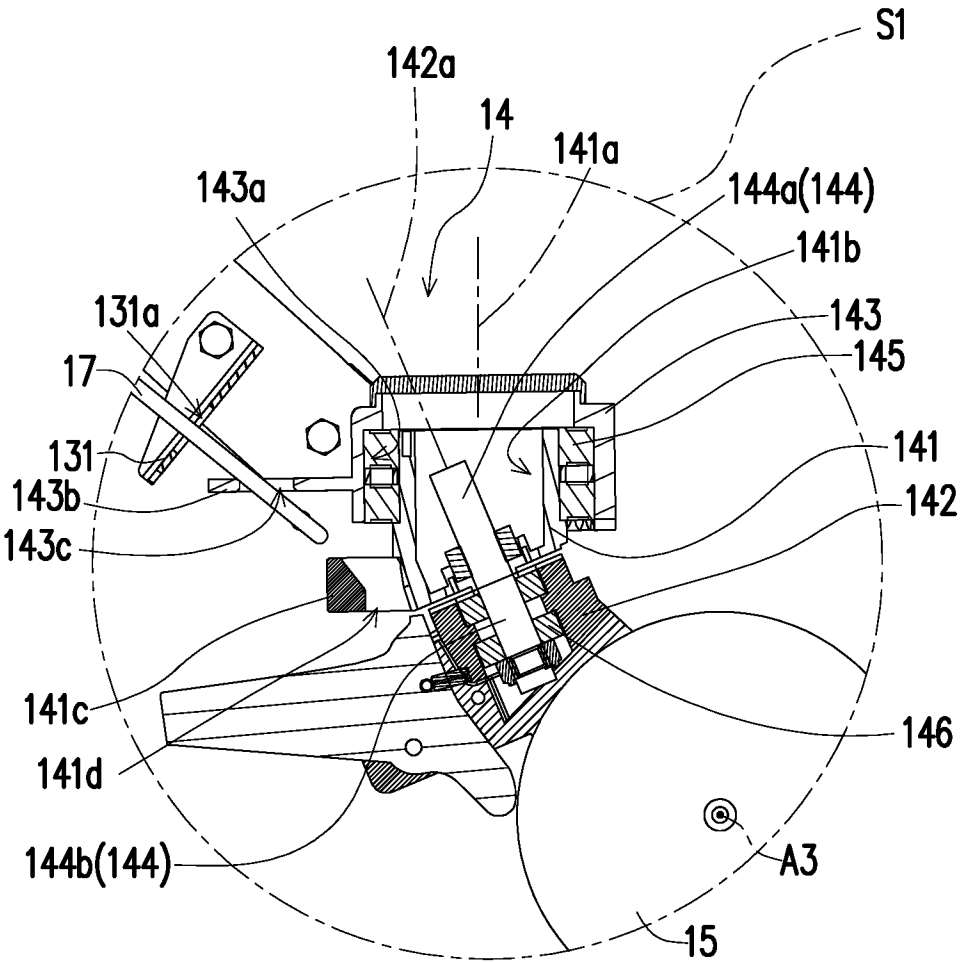
FIG. 1B is a schematic partially enlarged diagram of an area S1 depicted in FIG. 1A.
Figure 1C:
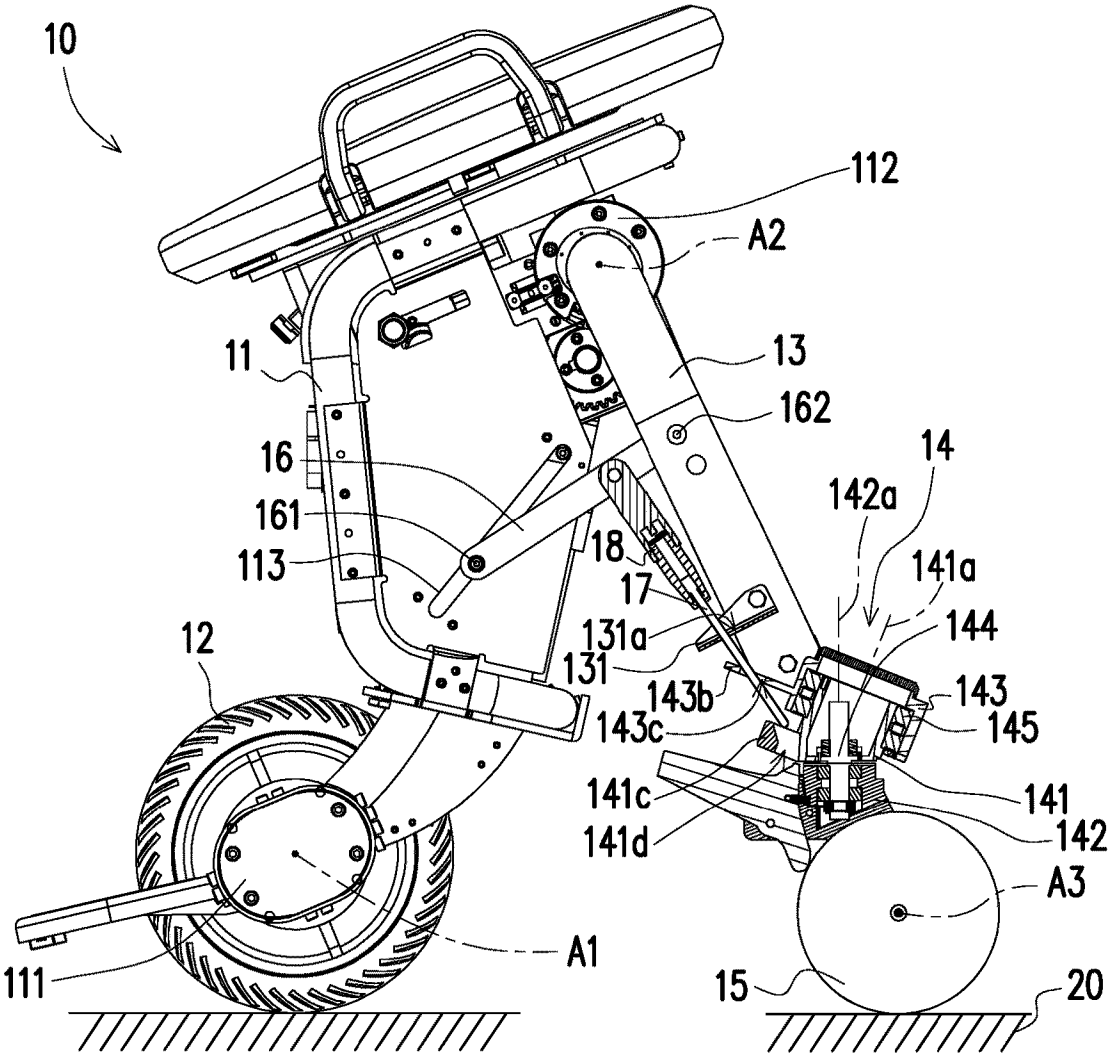
FIG. 1C is a schematic partial diagram illustrating the mobile carrier in a second state according to an embodiment of the invention.
Figure 1D:
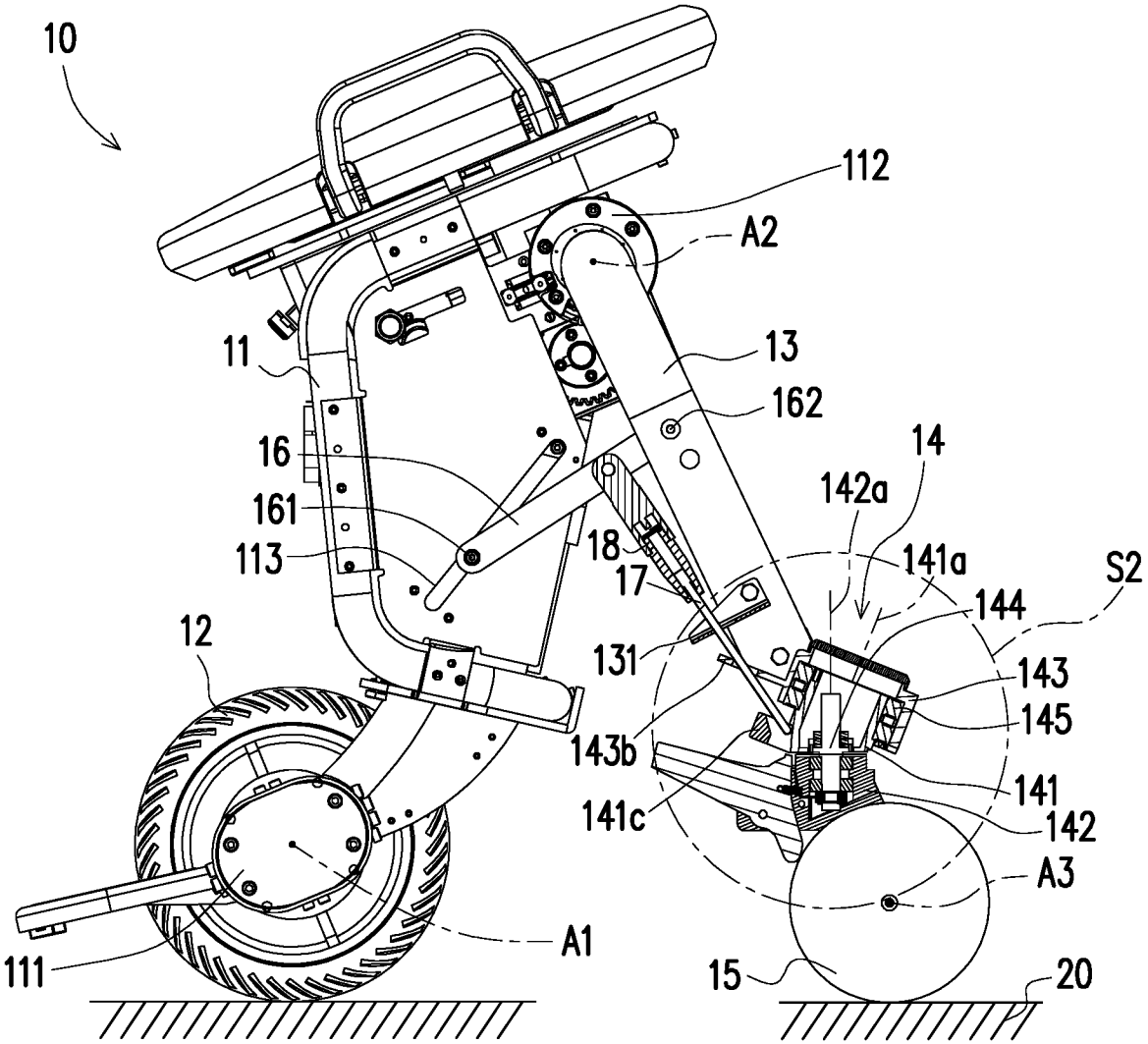
FIG. 1D is a schematic partial diagram illustrating the mobile carrier in a third state according to an embodiment of the invention.
Figure 1E:
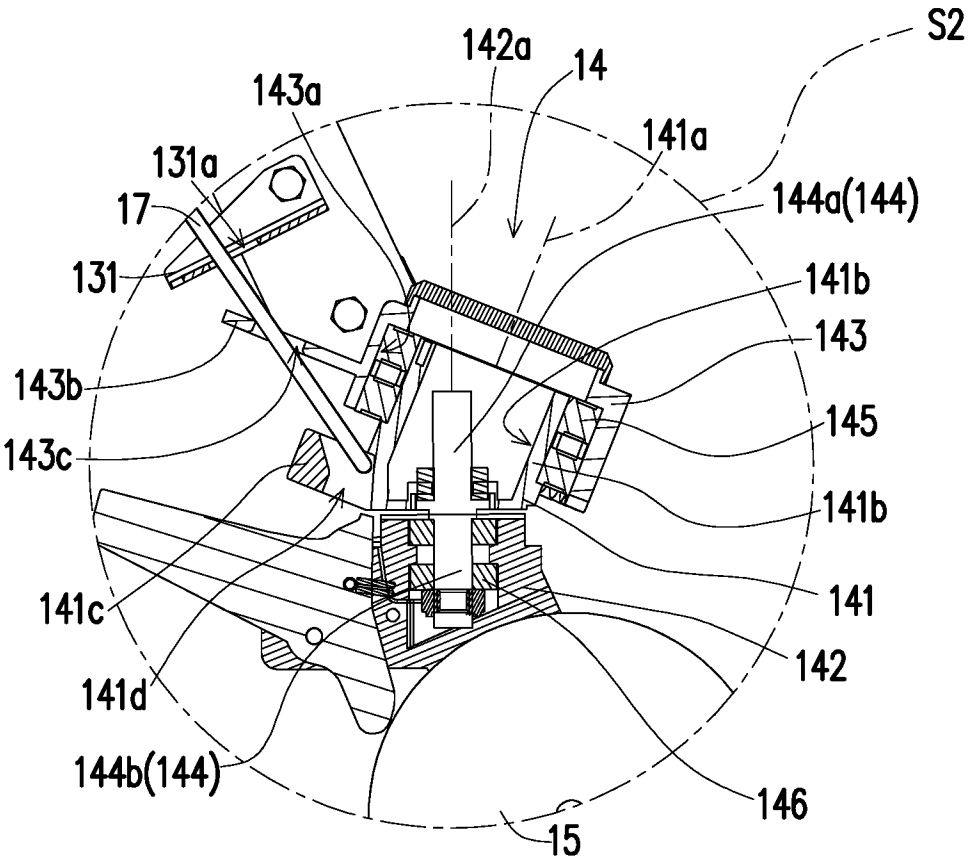
FIG. 1E is a schematic partially enlarged diagram of an area S2 depicted in FIG. 1D.

FIG. 1A is a schematic partial diagram illustrating a mobile carrier in a first state according to an embodiment of the invention. FIG. 1B is a schematic partially enlarged diagram of an area S1 depicted in FIG. 1A. FIG. 1C is a schematic partial diagram illustrating the mobile carrier in a second state according to an embodiment of the invention. FIG. 1D is a schematic partial diagram illustrating the mobile carrier in a third state according to an embodiment of the invention. FIG. 1E is a schematic partially enlarged diagram of an area S2 depicted in FIG. 1D. Referring to FIG. 1A to FIG. 1D first, in the present embodiment, a mobile carrier 10 may be a wheelchair, a walking aid device, an unmanned vehicle or any other mobile device equipped with a wheel set, which is not limited in the invention. The mobile carrier 10 includes a first frame 11, a directional wheel 12, a second frame 13, a steering adjustment mechanism 14 and a steering wheel 15. The directional wheel 12 and the second frame 13 are respectively connected to two opposite end portions of the first frame 11, and the second frame 13 is connected to the steering wheel 15 through the steering adjustment mechanism 14.

Furthermore, the first frame 11 has a first end portion 111 and a second end portion 112 opposite to each other, the directional wheel 12 is pivoted to the first end portion 111 along an axis A1, and the second frame 13 is pivoted to the second end portion 112 along an axis A2 in parallel to the axis A1. In other words, the directional wheel 12 is capable of rotating back and forth around the axis A1 relative to the first end portion 111, thereby driving the mobile carrier 10 to move forward or backward, and the second frame 13 is capable of rotating back and forth around the axis A2 relative to the second end portion 112, such that the mobile carrier 10 may be switched among a first state illustrated in FIG. 1A, a second state illustrated in FIG. 1C and a third state illustrated in FIG. 1D. On the other hand, the steering adjustment mechanism 14 is connected to another end portion of the second frame 13 which is opposite to the second end portion 112. Namely, the steering adjustment mechanism 14 and the second end portion 112 are respectively located at two opposite sides of the second frame 13.

In the present embodiment, the steering wheel 15 is configured to control a traveling direction of the mobile carrier, for example, to move straight or to turn, and the steering adjustment mechanism 14 is configured to ensure that the steering wheel 15 in the first state illustrated in FIG. 1A, the second state illustrated in FIG. 1C or the third state illustrated in FIG. 1D is capable of rotating relative to a plane 20 around the rotating axis which is perpendicular to the plane 20. Specifically, the steering adjustment mechanism 14 includes a first rotating element 141 and a second rotating element 142 coupled to the first rotating element 141, wherein the first rotating element 141 is connected to the second frame 13, and the steering wheel 15 is pivoted to the second rotating element 142 along an axis A3. On the other hand, the axes A1 to A3 are all substantially parallel to the plane 20. When the mobile carrier 10 moves straight, the axis A3 is parallel to the axis A1, and when the mobile carrier 10 is turned, the axis A3 is not parallel to the axis A1.

The steering adjustment mechanism 14 further includes a fixing element 143 and a connecting element 144, wherein the fixing element 143 is fixed to another end portion of the second frame 13 which is opposite to the second end portion 112, and the first rotating element 141 is pivoted to the fixing element 143 along a first rotating axis 141*a*. The second rotating element 142 and the fixing element 143 are respectively located at two opposite sides of the first rotating element 141, and the second rotating element 142 is pivoted to the first rotating element 141 along a second rotating axis 142*a*. Furthermore, the connecting element 144 has a third end portion 144*a* and a fourth end portion 144*b* opposite to each other, wherein the third end portion 144*a* is connected to the first rotating element 141, and the second rotating element 142 is pivoted to the fourth end portion 144*b*. In the present embodiment, the second rotating element 142 is connected to the fourth end portion 144*b* through at least one bearing 146 (schematically illustrated as two bearings in the drawing), wherein the bearings 146 are located in the second rotating element 142 and sleeved on the fourth end portion 144*b*. Additionally, an extension direction of the connecting element 144 is parallel to second rotating axis 142*a*. When the second rotating element 142 is turned by a force, the connecting element 144 is fixed firmly, and the second rotating element 142 is capable of rotating around the second rotating axis 142*a* relative to the connecting element 144 through the bearings 146.

In the present embodiment, the steering wheel 15 is capable of rotating around the first rotating axis 141*a* relative to the plane 20 through the first rotating element 141 and the second rotating element 142, thereby controlling the traveling direction of the mobile carrier 10. Alternatively, the steering wheel 15 is capable of rotating around the second rotating axis 142*a* relative to the plane 20 through the second rotating element 142, thereby controlling the traveling direction of the mobile carrier 10.

In the first state illustrated in FIG. 1A, the first rotating axis 141*a* of the first rotating element 141 is perpendicular to the plane 20, and the second rotating axis 142*a* of the second rotating element 142 tilts with respect to the plane 20. In other words, the first rotating axis 141*a* and the second rotating axis 142*a* are not parallel to each other. If the mobile carrier 10 in the first state illustrated in FIG. 1A is to be turned, due to a weight of the mobile carrier 10 and a force applied to the second rotating element 142 by the first rotating element 141, the second rotating element 142 is prevented from rotating around the second rotating axis 142*a* relative to the first rotating element 141. In other words, in the first state illustrated in FIG. 1A, the first rotating element 141 and the second rotating element 142 are locked to each other, and the first rotating element 141 and the second rotating element 142 are capable of rotating around the first rotating axis 141*a* simultaneously and rotating relative to the second frame 13 and the fixing element 143, thereby driving the steering wheel 15 to rotate around the first rotating axis 141*a* relative to the plane 20. Because the steering wheel 15 rotates around the first rotating axis 141*a* which is perpendicular to the plane 20, it facilitates increasing smoothness of the mobile carrier 10 when being turned and preventing the mobile carrier 10 when being turned from being overturned, so as to obtain preferable use reliability.

In the third state illustrated in FIG. 1D, the first rotating axis 141*a* of the first rotating element 141 tilts with respect to the plane 20, and the second rotating axis 142*a* of the second rotating element 142 is perpendicular to the plane 20. In other words, the first rotating axis 141*a* and the second rotating axis 142*a* are not parallel to each other. If the mobile carrier 10 in the third state illustrated in FIG. 1D is to be turned, due to a rotational degree of freedom of the first rotating element 141 being restricted, the first rotating element 141 is prevented from rotating around the first rotating axis 141*a* relative to the second rotating element 13 and the fixing element 143. In other words, in the third state illustrated in FIG. 1D, the first rotating element 141 is fixed firmly, and the second rotating element 142 is capable of rotating around the second rotating axis 142*a* relative to the first rotating element 141, thereby driving the steering wheel 15 to rotate around the second rotating axis 142*a* relative to the plane 20. Because the steering wheel 15 rotates around the second rotating axis 142*a* perpendicular to the plane 20, it facilitates increasing the smoothness of the mobile carrier 10 when being turned and preventing the mobile carrier 10 when being turned from being overturned, so as to obtain preferable use reliability.

Referring to FIG. 1A to FIG. 1E, in the present embodiment, the fixing element 143 may be a housing and has a first hollow portion 143*a*. The first rotating element 141 has a second hollow portion 141*b*, and the first hollow portion 143*a* is sleeved on the second hollow portion 141*b*. On the other hand, the steering adjustment mechanism 140 further includes at least one bearing 145 (schematically illustrated as two in the drawing), wherein the bearings 145 are disposed inside the first hollow portion 143*a*, and the second hollow portion 141*b* of the first rotating element 141 is connected to an inner wall surface of the first hollow portion 143*a* through the bearings 145. Furthermore, the bearings 145 are sleeved on the second hollow portion 141*b*, and the first rotating element 141 is capable of rotating around the first rotating axis 141*a* relative to the fixing element 143 through the bearings 145. The third end portion 144*a* of the connecting element 144 penetrates into the second hollow portion 141*b* and is capable of rotating around the second rotating axis 142*a* relative to the first rotating element 141. Thus, the second rotating element 142 fixed to the connecting element 144 is also capable of rotating around the second rotating axis 142*a* relative to the first rotating element 141.

The mechanism for restricting the rotational degree of freedom of the first rotating element 141 will be described below.

In the present embodiment, the first rotating element 141 further has a position-limiting portion 141*c* which is, for example, a portion protruding from an outer wall surface of the first rotating element 141 and disposed with a position-limiting hole 141*d*. The mobile carrier 10 further includes a linking element 16 and a position-limiting element 17, wherein the linking element 16 is connected to the first frame 11 and the second frame 13, and the position-limiting element 17 is connected to the linking element 16 and extends toward the position-limiting portion 141*c*. In the first state illustrated in FIG. 1A, the position-limiting element 17 and the position-limiting portion 141*c* are separated from each other. If the first frame 11 and the second frame 13 are made to rotate relative to each other around the axis A2 to reduce an included angle between the first frame 11 and the second frame 13, the mobile carrier 10 may be switched sequentially from the first state illustrated in FIG. 1A to the second state illustrated in FIG. 1C and the third state illustrated in FIG. 1D. In this circumstance, the linking element 16 is driven by the second frame 13 to move relative to the first frame 11, thereby driving the position-limiting element 17 to move toward the position-limiting portion 141*c*. In the third state illustrated in FIG. 1D, the position-limiting element 17 penetrates into the position-limiting hole 141*d* to generate structural interference with the position-limiting portion 141*c*, such that the first rotating element 141 is prevented from rotating around the first rotating axis 141*a* relative to the second rotating element 13 and the fixing element 143.

On the contrary, in the third state illustrated in FIG. 1D, if the first frame 11 and the second frame 13 are made to rotate relative to each other around the axis A2 to enlarge the included angle between the first frame 11 and the second frame 13, the mobile carrier 10 may be switched sequentially to the second state illustrated in FIG. 1C and the first state illustrated in FIG. 1A. In this circumstance, the linking element 16 is driven by the second frame 13 to move relative to the first frame 11, thereby driving the position-limiting element 17 to move out of the position-limiting hole 141*d* to release the structural interference with the position-limiting portion 141*c*, such that the first rotating element 141 in the first state illustrated in FIG. 1A is capable of rotating around the first rotating axis 141*a* relative to the second rotating element 13 and the fixing element 143.

In the present embodiment, the fixing element 143 has a first guide portion 143*b* which is, for example, a portion protruding from an outer wall surface of the fixing element 143 and disposed with a guide hole 143*c* (with reference to FIG. 1B). The second frame 13 has a second guide portion 131 which is, for example, a portion protruding from an outer wall surface of the second rotating element 13 and disposed with a guide hole 131*a* (with reference to FIG. 1B). The first guide portion 143*b*, the second guide portion 131 and the position-limiting portion 141*d* are located at the same side of the second frame 13, and the position-limiting element 17 penetrates through the guide holes 143*c* and 131*a*. In other words, the first guide portion 143*b* and the second guide portion 131 may be employed to guide the position-limiting element 17 to move toward the position-limiting hole 141*d* of the position-limiting portion 141*c*, thereby preventing the position-limiting element 17 in motion from shifting.

On the other hand, the linking element 16 has a sliding connection portion 161 and a pivoting portion 162 opposite to each other, and the first frame 11 further has a sliding guide portion 113, which is, for example, a slide slot. The sliding connection portion 161 is slidably disposed in the sliding guide portion 113, and the pivoting portion 162 is pivoted to the second frame 13. Thus, during the process of the first frame 11 and the second frame 13 being made to rotate relative to each other around the axis A2, the pivoting portion 162 of the linking element 16 is capable of rotating relative to the second frame 13, and the sliding connection portion 161 of the linking element 16 is capable of sliding along the sliding guide portion 113, thereby driving the position-limiting element 17 to move close to or far away from the position-limiting portion 141*c*.

In the present embodiment, the mobile carrier 10 further includes a sleeve 18, and the position-limiting element 17 is connected to the linking element 16 through the sleeve 18. The position-limiting element 17 passes through the sleeve 18 and configured to move back and forth relative to the sleeve 18. In other words, the sleeve 18 and the position-limiting element 17 form, for example, a telescopic rod structure. During the process of the mobile carrier 10 being switched sequentially from the first state illustrated in FIG. 1A to the second state illustrated in FIG. 1C and the third state illustrated in FIG. 1D, if the position-limiting element 17 abuts against a portion other than the position-limiting hole 141*d* in the position-limiting portion 141*c*, the position-limiting element 17, due to receiving a force, is partially retracted in the sleeve 18. Subsequently, the position-limiting element 17 is driven by a hydraulic or a pneumatic pressure to return to its original position, i.e., the part of the position-limiting element 17 which is retracted in the sleeve 18 is allowed to move out, thereby ensuring the position-limiting element 17 to penetrate into the position-limiting hole 141*d* in the position-limiting portion 141*c*.

Other embodiments are provided below for illustration. It should be noted that the reference numerals and a part of the contents in the previous embodiment are used in the following embodiments, in which identical reference numerals indicate identical or similar components, and repeated description of the same technical contents is omitted. The description related to the omitted parts can be found in the previous embodiment, and no repeated description is contained in the following embodiments.

Figure 2A:
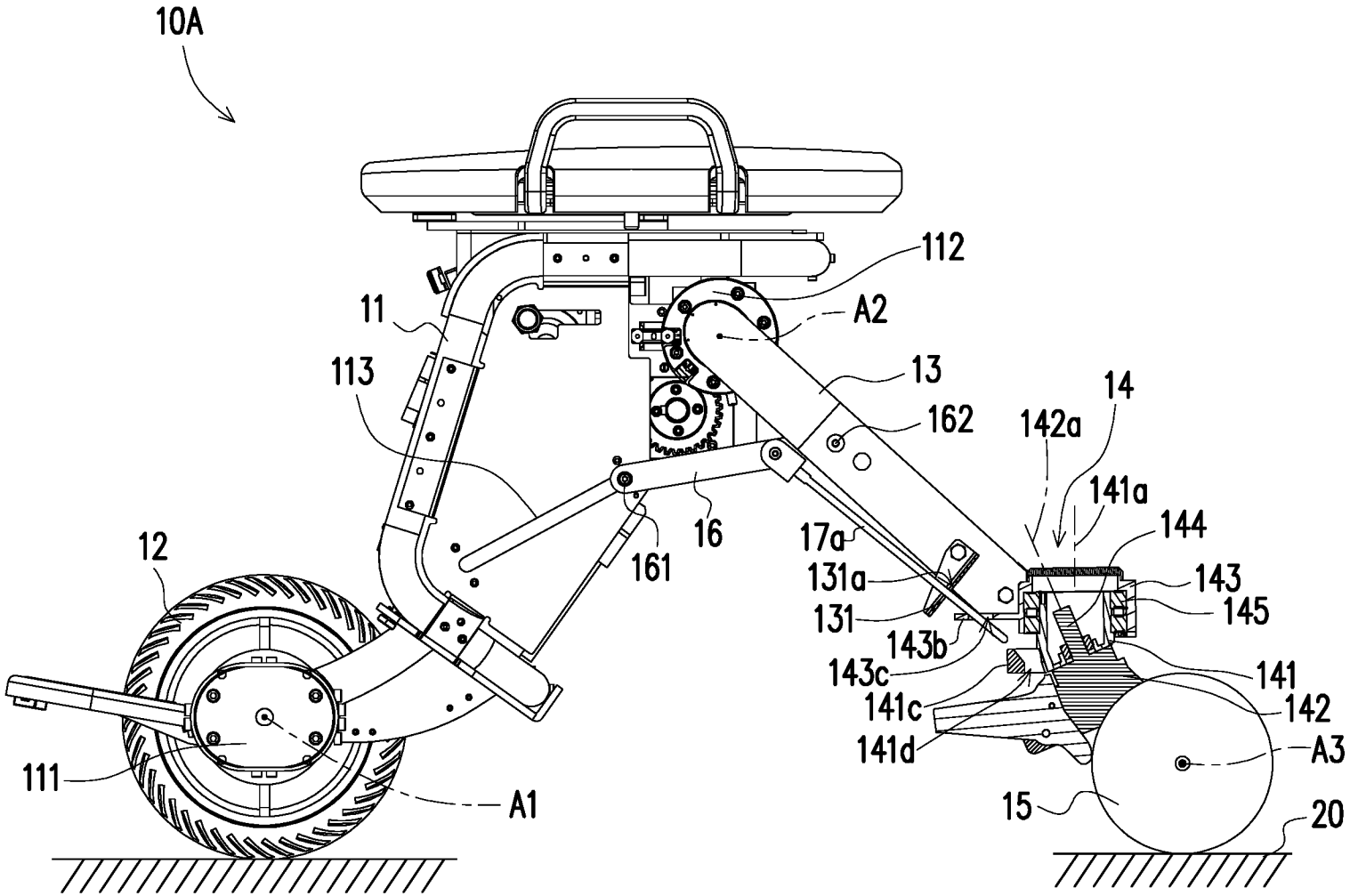
FIG. 2A is a schematic partial diagram illustrating the mobile carrier in the first state according to another embodiment of the invention.
Figure 2B:
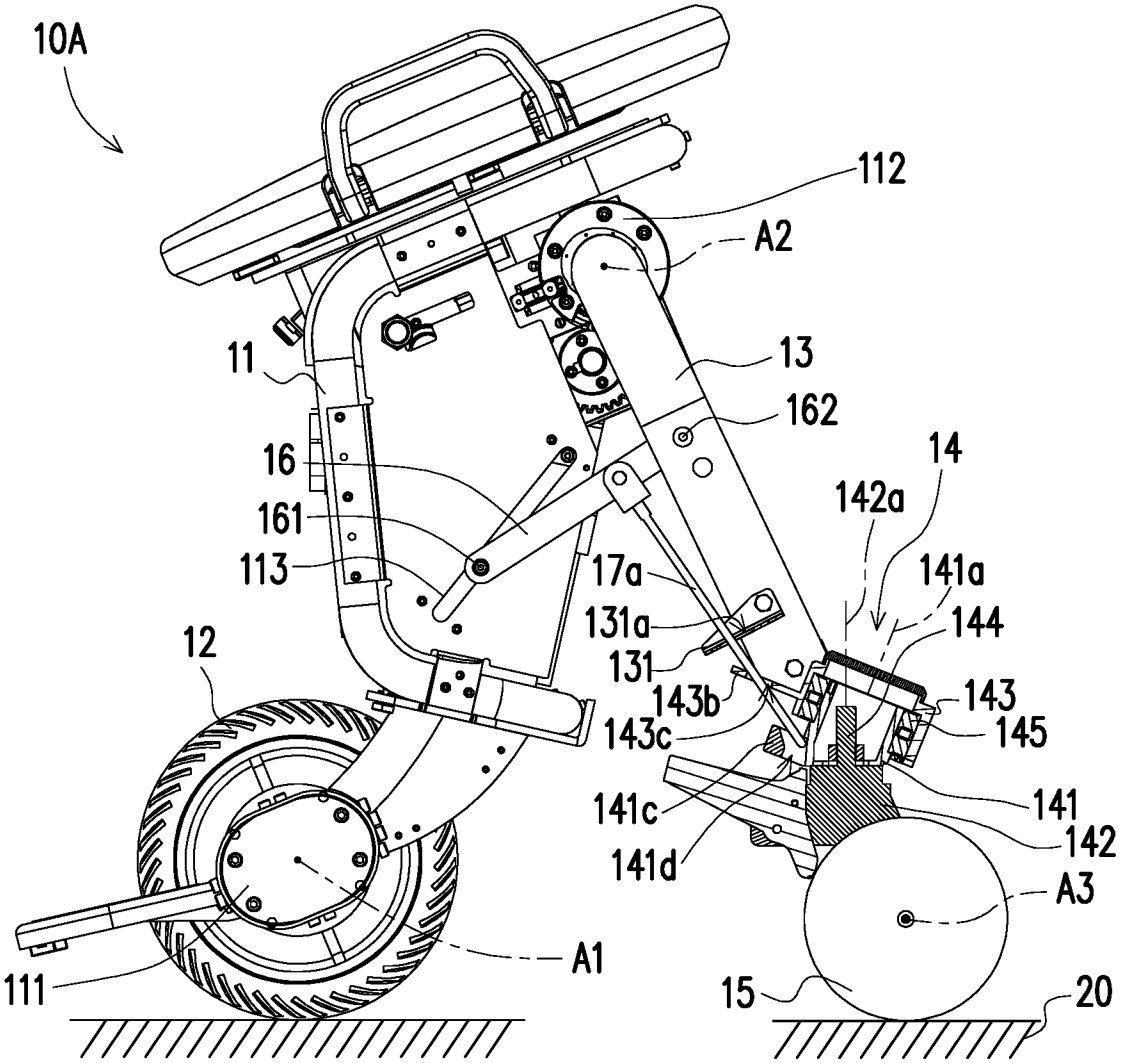
FIG. 2B is a schematic partial diagram illustrating the mobile carrier in the second state according to another embodiment of the invention.

FIG. 2A is a schematic partial diagram illustrating the mobile carrier in the first state according to another embodiment of the invention. FIG. 2B is a schematic partial diagram illustrating the mobile carrier in the second state according to another embodiment of the invention. Referring to FIG. 2A and FIG. 2B, a mobile carrier 10A of the present embodiment is substantially similar to the mobile carrier 10 in the previous embodiment, a difference between the two embodiments lies in that the position-limiting element 17 and the sleeve 18 form the telescopic rod structure, and the position-limiting element 17 is connected to the linking element 16 through the sleeve 18 in the previous embodiment. However, the position-limiting element 17 is directly connected to the linking element 16, and the telescopic mechanism is not provided in the present embodiment. On the other hand, the connecting element 144 and the second rotating element 142 of the present embodiment may be an integrally formed structure. In other words, the connecting element 144 is directly formed on the second rotating element 142 and fixed to the second rotating element 142 without locking, engagement or other assembly manners. In this way, not only structure strength and assembly convenience can be increased, but also manufacturing cost can be reduced. Furthermore, the second rotating element 142 is pivoted to the first rotating element 141 through the connecting element 144, such that when the second rotating element 142 is turned by a force, the second rotating element 142 and the connecting element 144 are capable of rotating around the second rotating axis 142*a* relative to the first rotating element 141 simultaneously.

In light of the foregoing, the mobile carrier of the invention can ensure that through the steering adjustment mechanism, the steering wheel can rotate around the rotating axis perpendicular to the plane (or the ground). In this way, the smoothness of the mobile carrier when being turned can be increased, and the mobile carrier when being turned can be prevented from being overturned, so as to obtain preferable use reliability. Furthermore, the steering adjustment mechanism at least includes the first rotating element and the second rotating element coupled to each other, and the steering wheel is pivoted to the second rotating element. When the mobile carrier is moved to be in one of the states, the first rotating axis of the first rotating element is perpendicular to the plane (or the ground), and the first rotating element and the second rotating element are locked to each other. In this circumstance, the first rotating element and the second rotating element can rotate around the first rotating axis simultaneously, thereby driving the steering wheel to rotate around the first rotating axis relative to the plane (or the ground). When the mobile carrier is moved to be in another one of the states, the second rotating axis of the second rotating element is perpendicular to the plane (or the ground), but the first rotating element cannot rotate. In this circumstance, the second rotating element can rotate around the second rotating axis relative to the first rotating element, thereby driving the steering wheel to rotate around the second rotating axis relative to the plane (or the ground).

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A mobile carrier, comprising:

a first frame, having a first end portion and a second end portion opposite to each other;

a directional wheel, pivoted to the first end portion;

a second frame, pivoted to the second end portion;

a steering adjustment mechanism, connected to the second frame, the steering adjustment mechanism and the second end portion being respectively located at two opposite sides of the second frame, and the steering adjustment mechanism comprising a first rotating element and a second rotating element coupled to the first rotating element, wherein the first rotating element has a first rotating axis, and the second rotating element has a second rotating axis; and a steering wheel, pivoted to the second rotating element, wherein when the first rotating axis is perpendicular to a plane, the first rotating element and the second rotating element are locked to each other, and the first rotating element and the second rotating element rotate around the first rotating axis simultaneously, and when the second rotating axis is perpendicular to the plane, a rotational degree of freedom of the first rotating element is restricted, and the second rotating element rotates around the second rotating axis relative to the first rotating element.

2. The mobile carrier according to claim 1, wherein the first rotating axis and the second rotating axis are not parallel to each other.

3. The mobile carrier according to claim 1, wherein the steering adjustment mechanism further comprising:

a fixing element, fixed to the second frame, wherein the first rotating element is pivoted to the fixing element; and a connecting element, having a third end portion and a fourth end portion opposite to each other, wherein the third end portion is connected to the first rotating element, and the second rotating element is pivoted to the fourth end portion.

4. The mobile carrier according to claim 3, wherein the fixing element has a first hollow portion, the first rotating element further has a second hollow portion, the first hollow portion is sleeved on the second hollow portion, and the steering adjustment mechanism further comprises a bearing, wherein the bearing is disposed in the first hollow portion and sleeved on the second hollow portion.

5. The mobile carrier according to claim 4, wherein the third end portion penetrates into the second hollow portion.

6. The mobile carrier according to claim 3, further comprising:

a linking element, connected to the first frame and the second frame; and a position-limiting element, connected to the linking element, wherein the first rotating element further has a position-limiting portion, the position-limiting element extends toward the position-limiting portion, the position-limiting element and the position-limiting portion are separated from each other when the first rotating axis is perpendicular to the plane, and during the process of the second frame and the first frame rotating relative to each other to cause the second rotating axis to be perpendicular to the plane, the second frame drives the linking element to move relative to the first frame, and the linking element drives the position-limiting element to move toward the position-limiting portion to generate structural interference with the position-limiting portion, so as to restrict the rotational degree of freedom of the first rotating element.

7. The mobile carrier according to claim 6, wherein the fixing element has a first guide portion, and the position-limiting element passes through the first guide portion.

8. The mobile carrier according to claim 7, wherein the second frame has a second guide portion, the position-limiting portion and the second guide portion are respectively located at two opposite sides of the first guide portion, and the position-limiting element passes through the second guide portion.

9. The mobile carrier according to claim 6, further comprising:

a sleeve, connected to the linking element, wherein the position-limiting element passes through the sleeve and is configured to move back and forth relative to the sleeve.

10. The mobile carrier according to claim 6, wherein the linking element has a sliding connection portion and a pivoting portion opposite to each other, the first frame further has a sliding guide portion, the sliding connection portion is slidably disposed in the sliding guide portion, and the pivoting portion is pivoted to the second frame.

11. A steering adjustment mechanism, comprising:

a first rotating element; and a second rotating element, coupled to the first rotating element, wherein the first rotating element has a first rotating axis, and the second rotating element has a second rotating axis, when the first rotating axis is perpendicular to a plane, the first rotating element and the second rotating element are locked to each other, and the first rotating element and the second rotating element rotate around the first rotating axis simultaneously, and when the second rotating axis is perpendicular to the plane, a rotational degree of freedom of the first rotating element is restricted, and the second rotating element rotates around the second rotating axis relative to the first rotating element.

12. The steering adjustment mechanism according to claim 11, wherein the first rotating axis and the second rotating axis are not parallel to each other.

13. The steering adjustment mechanism according to claim 11, wherein the steering adjustment mechanism further comprising:

a fixing element, wherein the first rotating element is pivoted to the fixing element; and a connecting element, having two opposite end portions, wherein one of the two end portions is connected to the first rotating element, and the second rotating element is pivoted to the other one of the two end portions.

14. The steering adjustment mechanism according to claim 13, wherein the fixing element has a first hollow portion, the first rotating element further has a second hollow portion, the first hollow portion is sleeved on the second hollow portion, and the steering adjustment mechanism further comprises a bearing, wherein the bearing is disposed in the first hollow portion and sleeved on the second hollow portion.

15. The steering adjustment mechanism according to claim 14, wherein one of the two end portions connected to the first rotating element penetrates into the second hollow portion.

16. The steering adjustment mechanism according to claim 13, wherein the first rotating element further has a position-limiting portion, a position-limiting element extends toward the position-limiting portion, the position-limiting element and the position-limiting portion are separated from each other when the first rotating axis is perpendicular to the plane, and when the second rotating axis to is perpendicular to the plane, the position-limiting element generate structural interference with the position-limiting portion, so as to restrict the rotational degree of freedom of the first rotating element.

17. The steering adjustment mechanism according to claim 16, wherein the fixing element has a first guide portion, and the position-limiting element passes through the first guide portion.

18. A steering adjustment mechanism, comprising:

a first rotating element, having a position-limiting portion, wherein a position-limiting element extends toward the position-limiting portion;

a second rotating element, coupled to the first rotating element, wherein the first rotating element has a first rotating axis, and the second rotating element has a second rotating axis;

a fixing element, wherein the first rotating element is pivoted to the fixing element; and a connecting element, having two opposite end portions, wherein one of the two end portions is connected to the first rotating element, and the second rotating element is pivoted to the other one of the two end portions, when the first rotating axis is perpendicular to a plane, the first rotating element and the second rotating element are locked to each other and the position-limiting element and the position-limiting portion are separated from each other, and the first rotating element and the second rotating element rotate around the first rotating axis simultaneously, and when the second rotating axis is perpendicular to the plane, the position-limiting element generate structural interference with the position-limiting portion, so as to restrict a rotational degree of freedom of the first rotating element, and the second rotating element rotates around the second rotating axis relative to the first rotating element.

* * * * *